US010918232B2

(12) United States Patent
Petrella

(10) Patent No.: US 10,918,232 B2
(45) Date of Patent: Feb. 16, 2021

(54) FOOD UTENSIL HAVING A RELEASABLE DECORATIVE ATTACHMENT

(71) Applicant: Filomena Petrella, Montreal-Nord (CA)

(72) Inventor: Filomena Petrella, Montreal-Nord (CA)

( * ) Notice: Subject to any disclaimer, the term of this patent is extended or adjusted under 35 U.S.C. 154(b) by 69 days.

(21) Appl. No.: 16/184,035

(22) Filed: Nov. 8, 2018

(65) Prior Publication Data

US 2019/0142193 A1 May 16, 2019

(30) Foreign Application Priority Data

Nov. 10, 2017 (GB) ..... 1718611

(51) Int. Cl.
*A47G 21/02* (2006.01)
*A47G 21/04* (2006.01)
*B26B 3/02* (2006.01)

(52) U.S. Cl.
CPC ..... *A47G 21/02* (2013.01); *A47G 21/023* (2013.01); *A47G 21/04* (2013.01); *B26B 3/02* (2013.01)

(58) Field of Classification Search
CPC ..... A47G 21/02; A47G 21/04; A47G 21/023; B26B 3/02; A63H 33/00; F16B 2/22
USPC ..... 30/141, 142, 147, 148, 149, 150, 322, 30/324, 325, 326, 327, 328
See application file for complete search history.

(56) References Cited

U.S. PATENT DOCUMENTS 519,717 A * 5/1894 Lane ..... B27B 17/0016 30/122
937,613 A * 10/1909 Kohonke ..... A47G 21/02 30/149
983,736 A 2/1911 Maconochie
2,752,678 A * 7/1956 Welch ..... A47G 21/04 30/324
2,833,084 A 5/1958 Hlousek
2,875,515 A 3/1959 Sieminski
2,889,624 A * 6/1959 McDonald ..... A47G 21/04 30/324
3,839,793 A * 10/1974 Crapio ..... A47G 21/02 30/123
4,719,702 A * 1/1988 Hoffman ..... A47G 21/02 30/324
4,779,344 A * 10/1988 Panisch ..... A47G 21/02 30/324
5,669,143 A * 9/1997 Wu ..... A47G 21/02 30/322
5,774,921 A * 7/1998 Harrison ..... A46B 5/00 15/145
5,917,701 A * 6/1999 Solberg ..... H01L 23/4093 257/E23.086
D414,382 S 9/1999 Crane et al.
5,946,807 A * 9/1999 Crane ..... A47G 21/181 30/141
6,004,634 A 12/1999 Aiken
D445,643 S 7/2001 Kazaklaris
(Continued)

FOREIGN PATENT DOCUMENTS

DE 202008005539 9/2008
DE 102009050410 11/2010
KR 2007025966 3/2007

*Primary Examiner* — Jonathan G Riley

(57) ABSTRACT

A food utensil including a handle and a utility portion. An attachment is removably attachable to the handle.

19 Claims, 4 Drawing Sheets

(56) References Cited

U.S. PATENT DOCUMENTS

| | | | | |
|---|---|---|---|---|
| 6,363,568 | B1 * | 4/2002 | Harrison | A46B 5/00 15/167.1 |
| D509,998 | S * | 9/2005 | Tranfaglia | D7/656 |
| D690,993 | S | 10/2013 | Im | |
| 8,839,522 | B2 * | 9/2014 | Walters | A47G 21/06 30/142 |
| 9,427,674 | B2 | 8/2016 | Oi | |
| 10,264,904 | B1 * | 4/2019 | Kim | A47G 21/08 |
| 2002/0073553 | A1 * | 6/2002 | Yang | A47G 21/06 30/150 |
| 2002/0112302 | A1 * | 8/2002 | Harrison | A46B 5/00 15/167.1 |
| 2004/0066343 | A1 * | 4/2004 | Puett, III | H01Q 1/3275 343/720 |
| 2004/0194323 | A1 * | 10/2004 | Lueck | A47G 21/02 30/323 |
| 2005/0278958 | A1 * | 12/2005 | Schmidt | A47G 21/06 30/324 |
| 2011/0003273 | A1 * | 1/2011 | Roggensack | A47G 21/02 434/127 |
| 2015/0257561 | A1 * | 9/2015 | Miksovsky | A47G 21/023 30/150 |
| 2016/0016092 | A1 * | 1/2016 | Oi | A63H 33/00 446/227 |
| 2016/0023504 | A1 * | 1/2016 | Shapiro | B44C 3/02 30/526 |
| 2017/0120490 | A1 * | 5/2017 | Shapiro | B29C 45/16 |
| 2018/0000267 | A1 * | 1/2018 | Kim | A47G 21/04 |

* cited by examiner

FOOD UTENSIL HAVING A RELEASABLE DECORATIVE ATTACHMENT

FIELD OF THE INVENTION

The present invention relates to the general field of food utensils and is more specifically concerned with a food utensil having a releasable decorative attachment.

BACKGROUND

On the market there is every appropriately styled and designed dining table cutlery to match any given diner event that can be imagined. The main disadvantage with these differently styled and designed dining table cutlery essentially resides in that a user must generally purchase a whole set that more specifically matches the theme of a special diner event. This option being generally too expensive, the user often ends up using the same high end cutlery set reserved only for special diner events or, otherwise, the relatively inexpensive everyday flatware set. It would be desired to be able to have an inexpensive manner of having custom decorations on table utensils so as to match a given style of diner event such as, for examples, a marriage celebration, a birthday party, a Halloween party or the likes.

Against this background, there exists a need in the industry to provide improved combination food utensil and decorative attachment. An object of the present invention is therefore to provide such combinations.

SUMMARY OF THE INVENTION

In a broad aspect, there is provided an assembly comprising: a food utensil defining a utility portion and a substantially elongated handle having substantially longitudinally opposed handle proximal and distal ends, the utility portion extending from the handle at the handle distal end, the handle defining substantially opposed handle first and second surfaces and a pair of handle lateral edges therebetween; and a decorative attachment removably attached to the food utensil, the decorative attachment including a decorative element provided at the handle first surface and a pair of laterally opposed handle engaging prongs having each a respective handle engaging prong free end portion provided on the handle second surface; wherein the handle defines a pair of laterally opposed handle recesses formed in the handle second surface, each handle recess receiving thereinto a respective one of the handle engaging prong free end portion, the handle recesses and handle engaging prong free end portions being complementarily shaped to maintain the decorative element secured at a predetermined location along the handle.

There may also be provided an assembly wherein at least one of the handle recesses and a corresponding one the handle engaging prong free end portions are polygonal.

There may also be provided an assembly wherein the handle recesses differ from being rotated images of each other and the handle engaging prong free end portions differ from being rotated images of each other.

There may also be provided an assembly wherein an overall longitudinal length of a first one of the handle recesses is smaller than an overall longitudinal length of a second one of the handle recesses.

There may also be provided an assembly wherein an overall lateral width of the first one of the handle recesses is larger than an overall lateral width of the second one of the handle recesses.

There may also be provided an assembly wherein a first one of the handle recesses is substantially square and a second one of the handle recesses is substantially L-shaped.

There may also be provided an assembly wherein a first one of the handle recesses is substantially rectangular and a second one of the handle recesses is substantially triangular.

There may also be provided an assembly wherein the handle engaging prongs are resiliently deformable, the handle engaging prongs being biased against the handle when the decorative attachment is operatively secured to the handle with the handle engaging prong free end portions received in the handle recesses.

There may also be provided an assembly wherein the decorative attachment is removable from the handle by spreading the handle engaging prongs and sliding the decorative attachment longitudinally along the handle.

There may also be provided an assembly wherein at least one of the handle recesses and the handle engaging prong free end portions is beveled to facilitate spreading of the handle engaging prongs when the decorative attachment is moved longitudinally along the handle.

There may also be provided an assembly wherein the handle engaging prong free end portions are separated by a gap, the gap being wider than a thickness of the handle at a removal location along the handle wherein the decorative attachment is removable from the handle.

There may also be provided an assembly wherein the decorative attachment snugly encircles at least part of a circumference of the handle.

There may also be provided an assembly wherein the predetermined location is spaced apart from both the handle proximal and distal ends.

There may also be provided an assembly wherein the handle second surface is provided with an indicia between the handle recesses.

There may also be provided an assembly wherein the decorative attachment includes a support portion defining the handle engaging prongs and a decorative element mounted to the support portion.

There may also be provided an assembly wherein the support portion includes a base abutting against the handle first surface, the handle engaging prongs extending from the base, a pair of opposed decorative element engaging prongs also extending from the base; and the decorative element defines a pair of opposed decorative element recesses, each decorative element engaging prongs being received in a respective one of the decorative element recesses to secure the decorative element to the support element.

There may also be provided an assembly wherein the handle lateral edges each define a respective convex portion in register with the handle recesses; and the handle engaging prongs each define a respective concave portion in register with and receiving thereinto a respective one of the convex portions.

There may also be provided an assembly wherein the decorative attachment extends substantially a whole handle length of the handle.

There may also be provided an assembly wherein the utility portion is selected from the group consisting of a knife blade, a fork end and a spoon end.

In another broad aspect, there is provided an assembly comprising: a food utensil defining a utility portion and a substantially elongated handle having substantially longitudinally opposed handle proximal and distal ends, the utility portion extending from the handle at the handle distal end; and a decorative attachment removably attached to the food utensil, the decorative attachment including a decorative element and a pair of laterally opposed attachment mating portions; wherein the handle defines a pair of laterally opposed handle mating portions formed in the handle, each handle mating portion snugly releasably mating with a respective one of the attachment mating portions to maintain the decorative element secured at a predetermined location along the handle, wherein the handle mating portions have geometric configurations that differ from each other so that the geometric configurations cannot be obtained one from an other through rotation, translation, or combinations thereof.

For the purpose of this document, a food utensil is a utensil that can be used for the preparation of food, handling of food and eating. In a specific embodiment, the food utensil is a table utensil used for eating or as a serving utensil.

Thus, there is provided a food utensil which can be user selectively decorated for special diner events. Furthermore, for example, a same conventional set of table utensils, such as a flatware set for everyday use, may be substantially easily and cost effectively transformed at will into a high class or highly decorated set of table utensils using different styles of the decorative attachment. Advantageously, the releasable decorative attachment may be easily removed from the table utensil such that both may be thoroughly washed individually by hand or in a dishwasher.

The present application claims priority from UK Request for a Patent 1718611.5 filed Nov. 10, 2017, the contents of which is hereby incorporated by reference in its entirety.

Other objects, advantages and features of the present invention will become more apparent upon reading of the following non-restrictive description of some embodiments thereof, given by way of example only with reference to the accompanying drawings.

DETAILED DESCRIPTION

The term "substantially" is used throughout this document to indicate variations in the thus qualified terms. These variations are variations that do not materially affect the manner in which the invention works and can be due, for example, to uncertainty in manufacturing processes or to small deviations from a nominal value or ideal shape that do not cause significant changes to the invention. These variations are to be interpreted from the point of view of the person skilled in the art. Directional terminology, such as proximal and distal, refers to the orientation of the food utensils described herein with respect to an intended user using the food utensil to handle food. Thus, distal elements are closer to the food and proximal elements are closer to a hand of the intended user.

FIGS. 1 to 7 inclusively illustrate various aspects of an embodiment of a food utensil 102 having a releasable decorative attachment 104 attached thereto, hereinafter referenced as the assembly 100. The food utensil 102 illustrated in FIGS. 1 to 7 is a spoon, but any other suitable food utensils 102 are within the scope of the appended claims.

Figure 1:
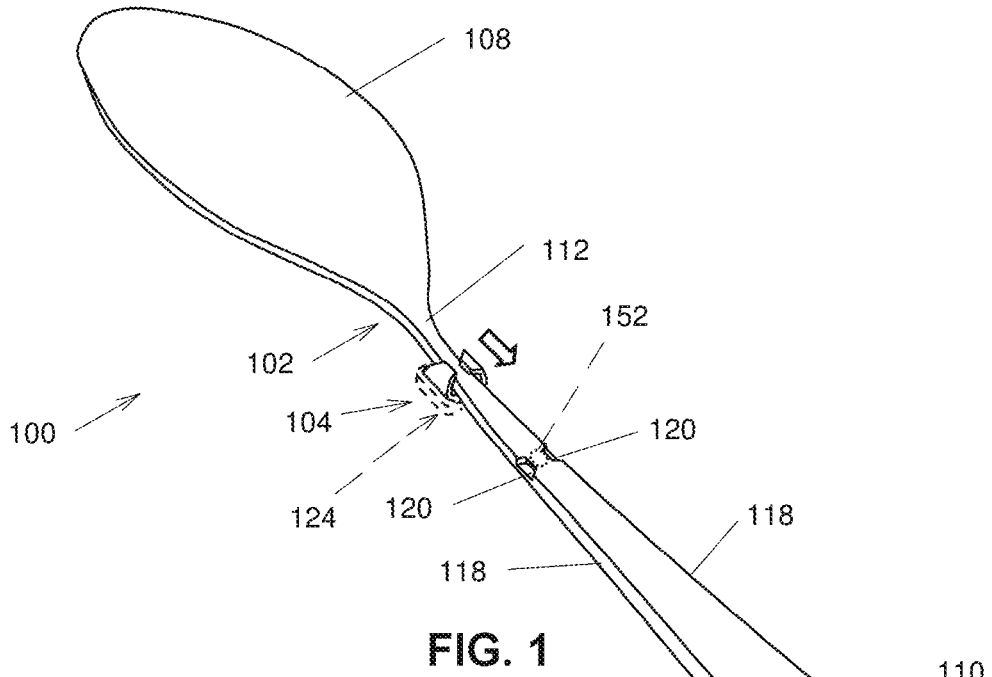
FIG. 1, in a bottom perspective view, illustrates an embodiment of a food utensil having a releasable decorative attachment, here showing the decorative attachment being movably engaged along a handle of the food utensil.
Figure 2:
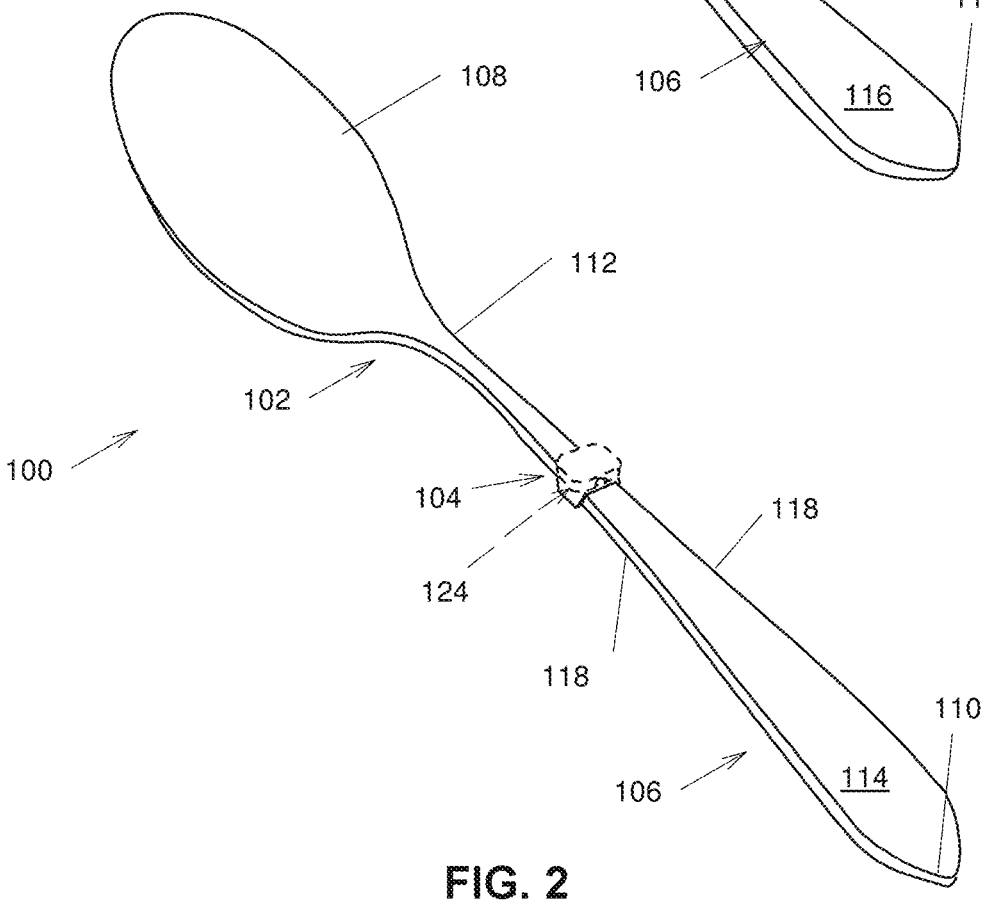
FIG. 2, in a top perspective view, illustrates the food utensil of FIG. 1; here showing the decorative attachment releasably engaged on the handle thereof.

Referring to FIGS. 1 and 2, The food utensil 102 includes a substantially elongated handle 106 and a utility portion 108. The handle 106 defines substantially longitudinally opposed handle proximal and distal ends 110 and 112. The utility portion 108 extends from the handle distal end 112. The handle 106 defines substantially opposed handle first and second surfaces 114 and 116 and a pair of handle lateral edges 118 therebetween. In some embodiments, the handle first surface 114 is a surface of the handle 106 that faces upwardly in typical use of the utensil 102. However, this is not necessarily the case in all embodiments.

The utility portion 108 of the food utensil 102 may be any type of utility portion 108 known in the cutlery and general food handling industry such as, for examples, a fork end, a spoon end, a knife blade, among others. Typically, the food utensil 102 of the present assembly 100 may be advantageously sold as a set of including many food utensils representing many types of utility portions 108. The food utensil 102 is typically made of stainless steel. Other known materials typically used in the cutlery industry are within the scope of the appended claims. In some embodiments, the food utensil 102 is a flatware utensil that may be manufactured using a known punch-press process on a sheet of stainless steel or similar material. Other known manufacturing processes for the food utensil 102 are also possible such as, for examples, an injection molding process, a laser cutting process, or the likes.

As seen in FIG. 1, the food utensil 102 defines at least one pair of laterally opposed handle recesses 120 formed in the handle second surface 116. Laterally for the purpose of the present document refer to an orientation perpendicular to a longitudinal axis of the handle 106. The handle recesses 120 are for example defined in a laterally spaced apart relationship and each extend from one of the handle lateral edges 118. The handle recesses 120 are used to maintain the decorative element 104 secured at a predetermined location along the handle 106, by receiving a correspondingly shaped portion thereof as further described below. In some embodiments, the predetermined location is spaced apart from both the handle proximal and distal ends 110 and 112. For example, the handle recesses 120 are located within a longitudinal half of the handle 106 closest to the handle distal end 112, which leaves the other longitudinal half of the handle 106 free of decorative attachment 104 for a secure hand grip of the user on the food utensil 102. In some embodiments, many pair of handle recesses 120 are provided at longitudinally spaced apart locations along the handle 106. The assembly 100 includes a number of decorative attachments 104 equal to a number handle recesses 120 pairs.

Figure 3:
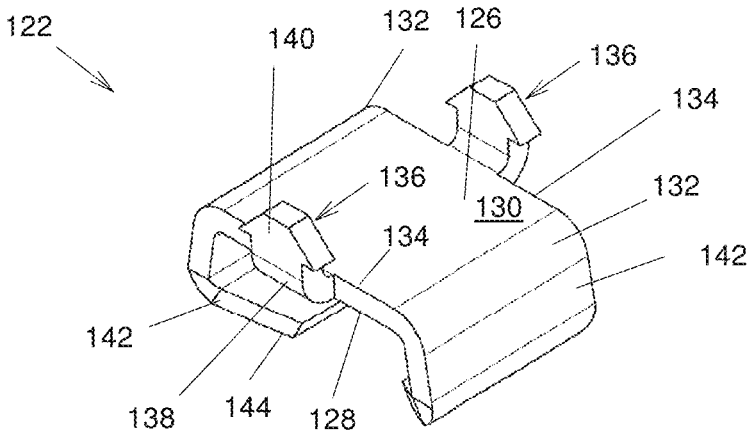
FIG. 3, in a top perspective view, illustrates a support portion part of the decorative attachment shown in FIGS. 2 and 3.

Referring jointly to FIGS. 3 to 7, each decorative attachment 104 generally includes a support portion 122, as best illustrated in FIG. 3, and a decorative element 124 attached to the support portion 122. In some embodiments, the support portion 122 and the decorative element 124 are integrally formed with each other or permanently fixed to each other through for example an adhesive of a press fit. In other embodiments, the support portion 122 and the decorative element 124 are detachable from each other. Such detachment may be made for example through a screw or other fastener. In some embodiments, the support portion 122 and the decorative element 124 are attached to each other using a prong and recess combination, as described hereinbelow.

Referring to FIG. 3, the support portion 122 includes a base 126, having for example a substantially planar configuration. Thus, the base 126 defines a base underside surface 128, a base upperside surface 130, opposed base longitudinal side edges 132, and opposed base transversal side edges 134 extending between the base longitudinal side edges 132. For orientation purposes, the base underside surface 128 faces the handle 106 and abuts against the handle first surface 114 when the support portion 122 is operationally secured thereto.

In a specific embodiment of the invention, the support portion 122 includes at least two decorative element engaging prongs 136 extending from opposed side edges of the base upperside surface 130. Each one in the at least two decorative element engaging prongs 136 includes an engaging prong extension portion 138 extending substantially perpendicularly upwardly relative to the base upperside surface 130, and is terminated with an enlarged end portion 140. The enlarged end portion 140 has a transversal dimension that is at least slightly greater than the transversal dimension of the engaging prong extension portion 138. For example, as illustrated in the figures, the support portion 122 includes two decorative element engaging prongs 136 extending substantially centrally relative to a respective one of the base transversal side edges 134. As exemplified in the figures, each of the enlarged end portion 140 may have an upwardly extending tapered end. Other shape configurations for the enlarged end portion 140 are also possible.

Figure 4:
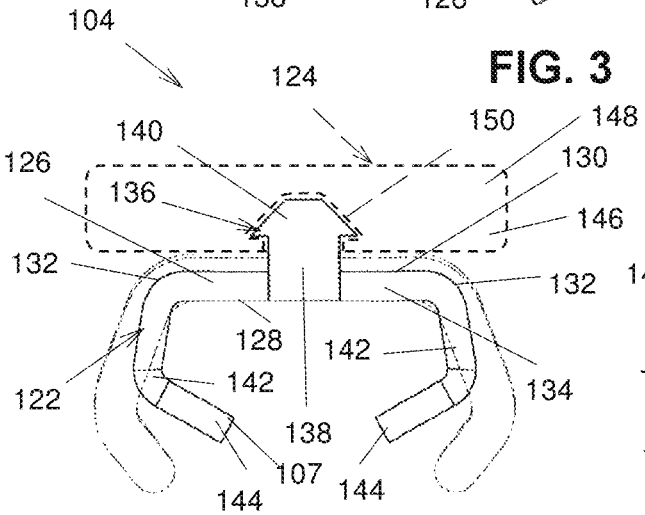
FIG. 4, in an end elevational view, illustrates the decorative attachment including the support portion of FIG. 3 and a decorative element (in dashed lines)
Figure 5:
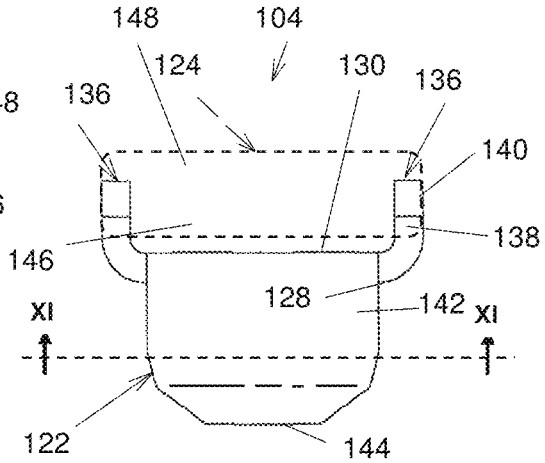
FIG. 5, in a side elevational view, illustrates the decorative attachment of FIG. 4.
Figure 6:
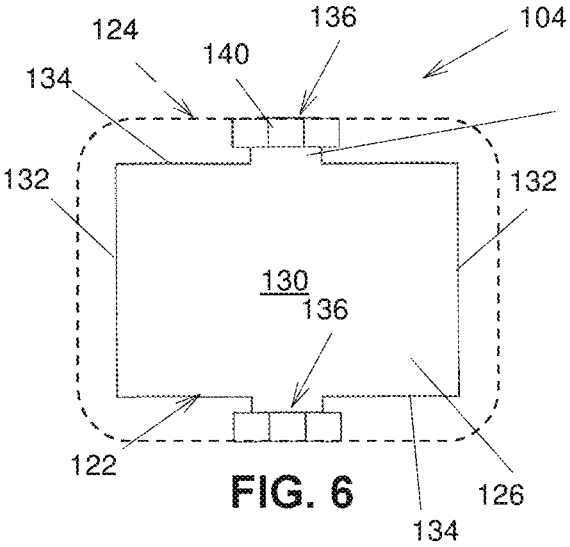
FIG. 6, in a top plan view, illustrates the decorative attachment of FIG. 4, FIG. 7, in a bottom plan view, illustrates the decorative attachment of FIG. 4.
Figure 7:
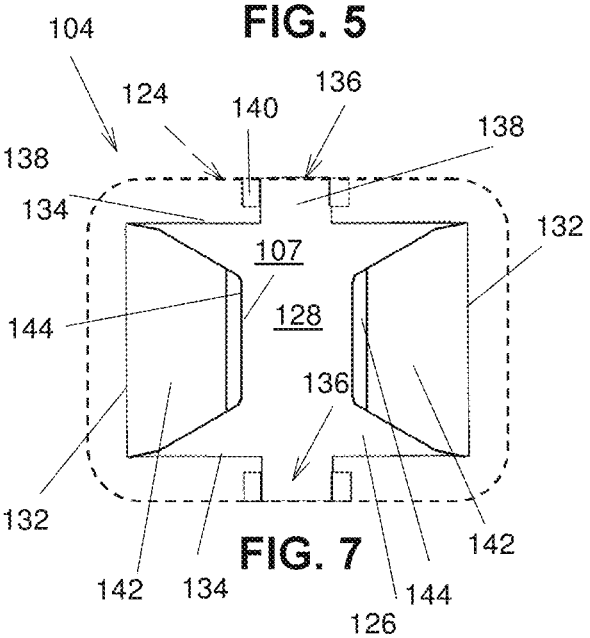

The support portion 122 further includes a pair of laterally opposed handle engaging prongs 142. For example, each handle engaging prong 142 extends substantially perpendicularly downwardly from a respective one of the base longitudinal side edges 132, with at least part of the handle engaging prong 142 oriented at an oblique angle inwardly relative to the base 126. Thus, the base 126 and the pair of handle engaging prongs 142 cooperatively define a substantially C-shaped configuration when the support portion 122 is viewed from a longitudinal end, as illustrated in FIG. 4.

The handle engaging prongs 142 have each a respective handle engaging prong free end portion 144. The handle engaging prong free end portions are suitably shaped and sized for engaging in a snug fit relation a respective handle recess 120 of the handle 106. Thus, each handle recess 120 receives thereinto a respective one of the handle engaging prong free end portions 144 and the handle recesses 120 and handle engaging prong free end portions 144 are complementarily shaped. The handle engaging prong free end portions 144 are typically provided on the handle second surface 116 when the handle engaging prong free end portions 144 are engaged in the handles recesses 120.

In some embodiments, the inner surface of the C-shaped configuration cooperatively formed by the base 126 and the pair of handle engaging prongs 142 is suitably sized and shaped for engaging in a snug fit relation the contiguous circumferential section of the handle 106 formed by the handle first surface 114, the handle lateral edges 118 and the inner surface of the handle recesses 120. Thus, the decorative attachment 104 snugly encircles part of a circumference of the handle 106.

In some embodiments, the handle engaging prong free end portions 144 and the handle recesses 120 have compatible shape configurations that are at least slightly rounded or inwardly tapered transversally towards one another (as exemplified in FIGS. 1 to 7), as well as having at least slightly rounded edges. Thus, manual attachment and removal of the decorative attachment 104 on the food utensil 102 is facilitated.

Still furthermore, the handle engaging prong free end portions 144 are sufficiently spaced apart from one another at their free ends to define a gap 107 that is wider than a thickness of the handle 106 at a removal location along the handle 106 wherein the decorative attachment 104 is removable from the handle 106. For example the removal location is at the handle proximal end 112. The utility of this characteristic will be described along with a description of a method of releasably attaching the decorative attachment 104 on the food utensil 102 further below.

The support portion 122 is made of a substantially resiliently rigid material such as metal or plastic, so as to return to its original shape after the handle engaging prongs 142 have been slightly stretched apart, as illustrated in FIG. 4. The support portion 122 may be made out of a sheet of metal using a suitable punch-press process, or of metal or plastic using a suitable injection molding process, among other possibilities. With such resiliently deformable handle engaging prongs 142, the handle engaging prongs 142 are biased against the handle 106 when the decorative attachment 104 is operatively secured to the handle 106 with the handle engaging prong free end portions 144 received in the handle recesses 120.

Alternatively, in some embodiments of the assembly 100 (not shown in the figures), the support portion 122 may be made out of a single metal wire suitably bent to replicate to the contour edge thereof, including the at least two decorative element engaging prongs 136.

The decorative element 124, illustrated in dashed lines in the figures, generally defines a decorative element lower portion 146 and a decorative element upper portion 148. The decorative element lower portion 146 has an underside surface portion thereof that is suitably shaped and sized to substantially extend parallelly in an at least slightly spaced apart relationship relative to the base upperside surface 130.

Furthermore, the decorative element lower portion 146 has opposed lateral side surface portions thereof defining suitably sized, shaped and positioned decorative element recesses 150 each for receiving in and lockingly engaging in a snug fit relation a respective one of the at least two decorative element engaging prongs 136, as illustrated in FIG. 4.

Thus, the decorative element 124 may be rigidly engaged and secured in a permanent lock fit relation with the support portion 122, yet, without interfering with the spreading movement of the pair of handle engaging prongs 142 of the support portion 122 when the latter are engaged along the handle 106 of the food utensil 102.

Although the enlarged end portions 140 of the decorative element engaging prongs 136, and the correspondingly sized and shaped decorative element recesses 150 have a substantially upwardly extending tapered configuration, it is to be understood that other shape configurations are also possible such as, for example, a semi-circular, square or rectangular configuration.

Furthermore, the decorative element upper portion 148 of the decorative element 124, may have dimension values that are relatively smaller, substantially similar or greater than, the decorative element lower portion 146. Typically, as illustrated in FIGS. 1 and 2, the decorative element upper portion 148 is sufficiently sized and shaped for at least partially hiding the decorative element lower portion 146 and support portion 122. It is to be understood that other dimension values for the decorative element upper portion 148 are also possible.

In the above discussion, directional terminology such as upper and lower refer to a typical orientation wherein the decorative attachment 104 is provided on top of the utensil 102 when the latter is in a typical orientation in use. This terminology is to facilitate the description of the decorative attachment 104 and should not be used to restrict the scope of the appended claims as using a decorative attachment in any other suitable orientation is within the scope of the appended claims.

Figure 8:
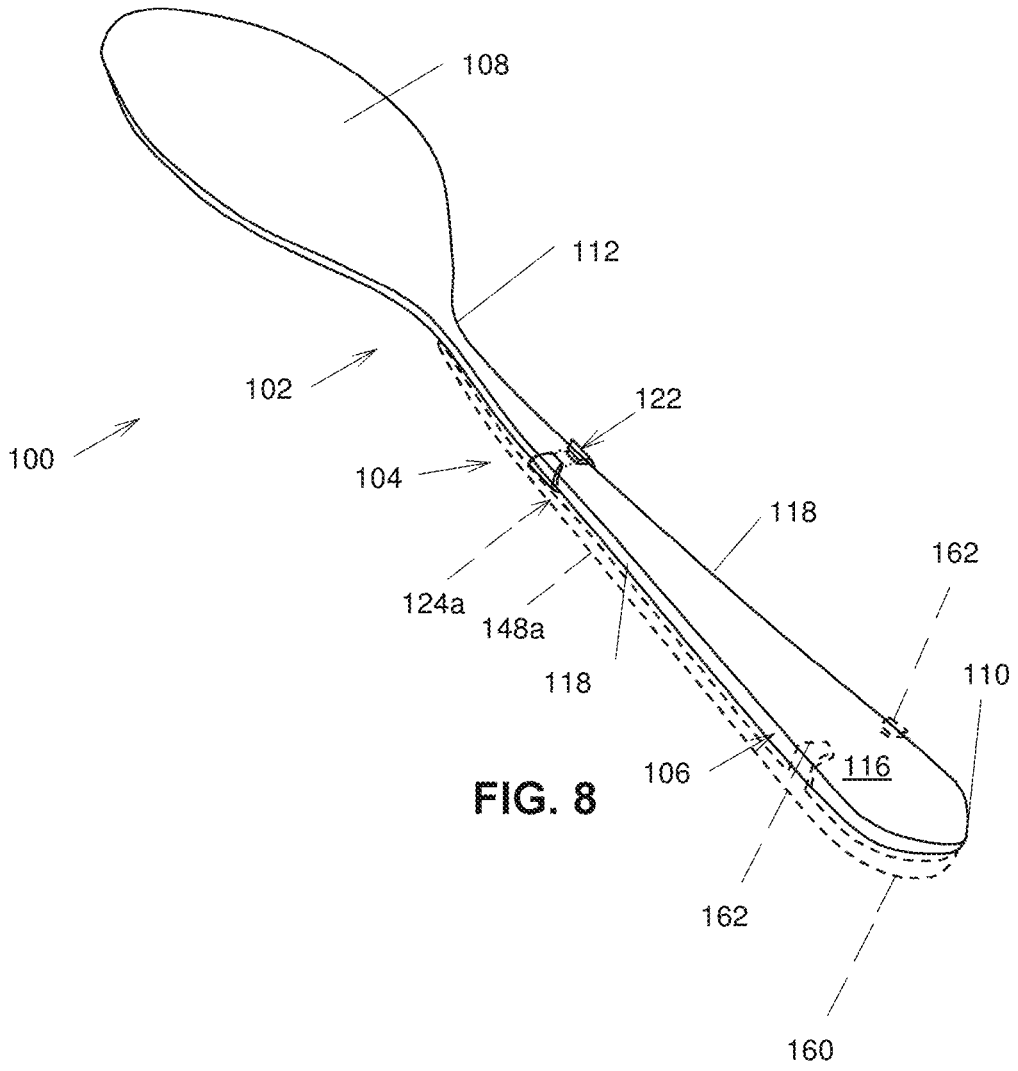
FIG. 8, in a bottom perspective view, illustrates another embodiment of a food utensil having a substantially elongated releasable decorative attachment.

As illustrated in FIG. 8, in some embodiments, the decorative element upper portion 148*a* may extend the whole longitudinal length of the handle first surface 114. The thus elongated decorative element upper portion 148*a* may have a proximal end portion 160 thereof provided with a pair of opposed auxiliary prongs 162 that are suitably shaped and sized for slidably engaging at least partially a cross-section of the handle 106 adjacent the handle proximal end 110. The method of releasably attaching the decorative element 124*a* including such an elongated decorative element upper portion 148*a* on the food utensil 102 is substantially the same as a relatively shorter decorative element 124.

The decorative element 124 may be any type of user selected decorative element such as, for examples, a jewel such as a precious or synthetic stone, a themed decorative object such as a birthday party figurine or symbol, a Halloween figurine, or the likes. Furthermore, the decorative element 124 may be made of any suitable material or a combination of materials such as, for examples, metal, plastic, a natural stone, or the likes. In some embodiments, the decorative attachment 104, including the decorative element 124 thereof, is made of food and dishwasher safe materials.

A method of releasably attaching the decorative attachment 104 on the food utensil 102 will now be described. Referring to FIG. 1, in a first step, the decorative attachment 104 has the spaced apart handle engaging prong free end portions 144 of its pair of handle engaging prongs 142 freely engaged, typically sideways, over the thickness of the handle 106 at the handle distal end 112, or neck, of the food utensil 102. The handle distal end 112, or neck of the food utensil 102, is typically the narrowest portion of the handle 106. In a second step, the decorative attachment 104 is rotated such that the base underside surface 128 of the support portion 122 is positioned substantially parallelly above the handle first surface 114. In a third step, the decorative attachment 104 is slidably pushed towards the handle proximal end 110 until the pair of handle engaging prongs 142 are resiliently engaged in a spring biased relationship in a user selected pair of handle recesses 120. It is to be noted that, as the decorative attachment 104 is thus slid towards the handle proximal end 110, and prior to reaching the pair of handle recesses 120, the pair of handle engaging prongs 142 are at least slightly spread apart due to the cross-sectional dimension, or width, of the handle 106, as illustrated in FIG. 4. This provides a force biasing the handle engaging prongs 142 towards the handle 106. To remove the decorative attachment 104 from the food utensil 102, the method is executed in the reverse order of the steps described above.

In the embodiments of the assembly 100 having more than one pair of handle recesses 120 defined in a spaced apart relationship along the handle 106 of the food utensil 102, more than one decorative attachment 104 may thus be releasably attached and removed therealong using substantially the same method as described above. The difference with the previously described method essentially resides in that, one by one, each decorative attachment 104 is freely engaged on the handle 106 at the handle distal end 112, or neck of the food utensil 102, followed with slidably pushing the latter towards the handle proximal end 110 until it is engaged in the free pair of handle recesses 120 that is closest thereto. Hence, the multiple decorative attachments 104 may then be removed one by one from the handle 106 starting with the decorative attachment 104 that is closest to the handle distal end 112, or neck of the food utensil 102. Thus, the present assembly 100 provides a food utensil 102 which can be user selectively decorated for special diner events.

Furthermore, a same conventional set of table utensils 102, such as a flatware set for everyday use, may be substantially easily and cost effectively transformed at will into a high class or highly decorated set of table utensils 102 using different styles of the decorative attachment 104. Advantageously, the releasable decorative attachment 104 may be easily removed from the food utensil 102 such that both may be thoroughly washed individually by hand or in a dishwasher.

In some embodiments of the present assembly 100, as illustrated in FIG. 2, the handle 106 may further include an indicia 152 defined in the handle second surface 116, for example between the handle recesses 120. The indicia 152 is useful for clearly indicating the location along the handle 106 where the decorative attachment 104 must be positioned, with reference to paper or online instruction documentation associated with the assembly 100. The indicia 152 may also add some ornamental design to the food utensil 102. The indicia 152 may be represented by any suitable indication such as, for examples, a star, a circle, a letter, a custom symbol, or the like. Furthermore, the indicia 152 may be embedded encrusted, slightly protruding or otherwise printed on the rear surface of the handle 106.

Figure 9:
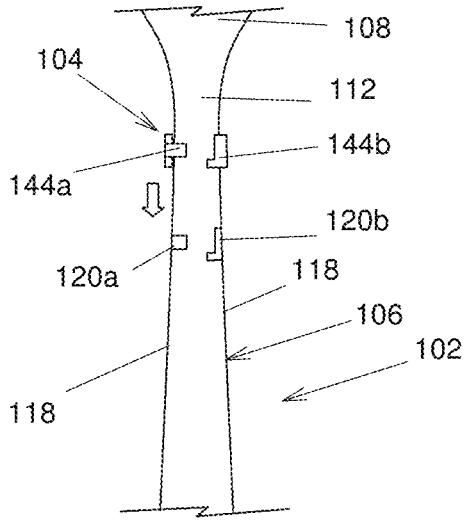
FIG. 9, in a partial, bottom plan view, illustrates yet another embodiment of a food utensil having a releasable decorative attachment.
Figure 10:
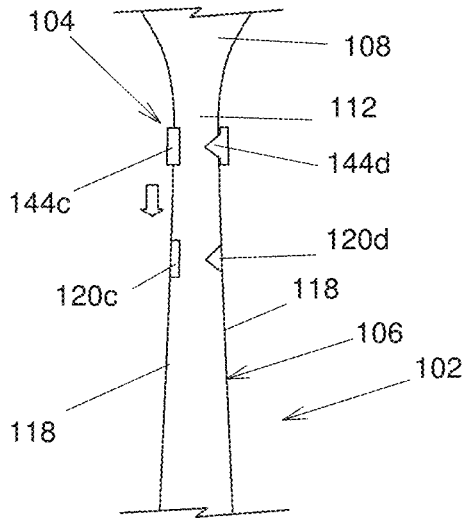
FIG. 10, in a partial, bottom plan view, illustrates yet another embodiment of a food utensil having a releasable decorative attachment.

FIG. 9 illustrates an alternative embodiment of the handle engaging prong free end portions 144*a* and 144*b*, of the pair of handle engaging prongs 142, having a keyed configuration adapted for engaging compatibly shaped handle recesses 120*a* and 120*b* defined along a handle 106. Similarly, FIG. 10 illustrates an other alternative embodiment of the handle engaging prong free end portions 144*c* and 144*d*, of the pair of handle engaging prongs 142, having a keyed configuration adapted for engaging compatibly shaped handle recesses 120*c* and 120*d* defined along a handle 106. In these embodiments, the handle engaging prong free end portions 144*a*, 144*b*, 144*c* and 144*d* of each pair of handle engaging prongs 142, and compatibly shaped handle recesses 120*a*, 120*b*, 120*c* and 102*d*, are suitably configured for allowing the decorative attachment 104 to be unmistakably engaged in a same longitudinal orientation relative to the food utensil 102. To that effect, the handle recesses 120*a* and 120*b*, and the handle recesses 120*c* and 120*d*, pairwise differ from being rotated images of each other. The handle engaging prong free end portions 144*a*, 144*b*, 144*c* and 144*d* also differ from each other pairwise similarly.

In some embodiments, handle engaging prong free end portions 144*a*, 144*b*, 144*c* and 144*d* have a keyed configuration, and the compatibly shaped handle recesses 120*a*, 120*b*, 120*c* and 102*d*, have compatibly shaped polygonal configurations (e.g. that are made of a plurality of rectilinear edges), so as to effectively secure a true longitudinal alignment of the decorative attachment 104 relative to the longitudinal axis of the food utensil 102.

For example, in FIG. 9, one of the handle engaging prong free end portion 144*a* and its compatibly shaped handle recess 120*a* have a substantially square-shaped configuration as viewed in a bottom plan view, while their paired handle engaging prong free end portion 144*b* and respective handle recess 120*b* have a substantially L-shaped configuration. Furthermore, the square-shaped configuration is relatively smaller than the L-shaped configuration. In another example, in FIG. 10, one of the handle engaging prong free end portion 144*c* and its compatibly shaped handle recess 120*c* have a substantially elongated and narrow rectangular configuration as viewed in a bottom plan view, while their paired handle engaging prong free end portion 144*d* and respective handle recess 120*d* have a substantially triangular configuration. Furthermore, the triangular-shaped configuration has a relatively greater lateral dimension and a relatively shorter longitudinal dimension than the rectangular configuration. Thus, an overall longitudinal length the handle recess 144*d* is smaller than an overall longitudinal length of the handle recess 144*c*. Also, an overall lateral width of the handle recess 144*d* is larger than an overall lateral width of the handle recess 144*c*. Other keyed configurations of the handle engaging prong free end portion 144*a* to 144*d* and compatibly shaped handle recesses 120*a* to 120*d* are also possible.

Figure 11:
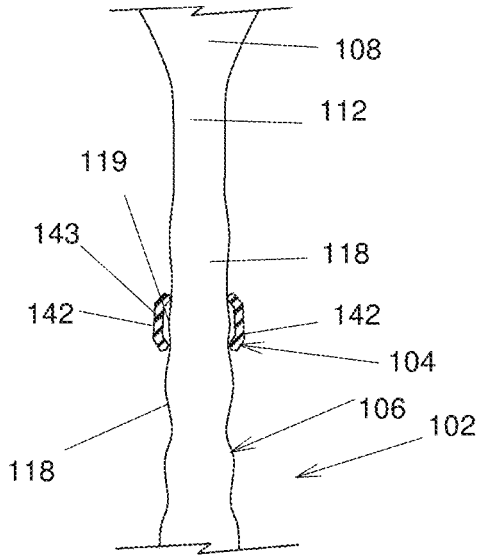
FIG. 11, in a cross-sectional view taken along section line XI-XI in FIG. 5, illustrates yet another embodiment of a food utensil having a releasable decorative attachment.

Referring to FIG. 11, in some embodiments, the pair of handle engaging prongs 142 may each have oppositely facing c-shaped cross-sections proximally opposed handle lateral edges 118 of a handle 106, so as to have each handle engaging prong 142 more efficiently stably engage spaced apart portions along irregularly shaped handle lateral edges 118. Along such irregular longitudinal side edges 118, the c-shaped cross-section of each handle engaging prong 142 may further secure the longitudinal alignment of the decorative attachment 104 relative to the general longitudinal axis of the food utensil 102. More specifically, in such embodiments, the handle lateral edges 118 each define a respective convex portion 119 in register with the handle recesses 120 (not shown in FIG. 11) and the handle engaging prongs 142 each define a respective concave portion 143 in register with and receiving thereinto a respective one of the convex portions 119.

Figure 12:
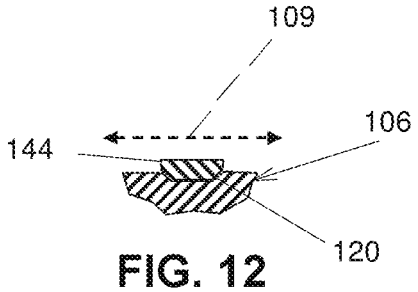
FIG. 12, in a longitudinal side cross-sectional view, illustrates a specific example of mating between the handle and the decorative attachment of the food utensils shown in FIGS. 1 to 11.

Referring to FIG. 12, in some embodiments, the handle engaging prong free end portions 144 may each have inner beveled or rounded side edges along at least portions thereof that are contacting the inner surface of respective handle recess 120, for facilitating the engagement and retrieval of the decorative element 104 from the handle recesses 120 along a longitudinal axis 109 of the food utensil 102. Indeed, such detachment of the decorative attachment 104 from the handle 106 is performed by spreading the handle engaging prongs 142 and sliding the decorative attachment 104 longitudinally along the handle 106. Spreading the handle engaging prongs 142 is typically achieved as a consequence of moving the decorative attachment 104 along the handle 106, which forces the handle engaging prong free end portions 144 out of the handle recesses 120 and therefore spread slightly the handle engaging prongs 142 as the handle 106 is slightly thicker adjacent the handle recesses 120 than at the handle recesses 120. In other embodiments, the handle recesses 120 or both the handle recesses 120 and the handle engaging prong free end portions 144 are beveled.

While a food utensil 102 including handle recesses 120 and a decorative attachment 104 including handle engaging prongs 142 has been described, in alternative embodiments, other combinations are possible. For example the decorative attachment 104 my define recesses receiving protrusions protruding from the handle 106. Thus, in some embodiments, there is provided an assembly comprising: a food utensil defining a utility portion and a substantially elongated handle having substantially longitudinally opposed handle proximal and distal ends, the utility portion extending from the handle at the handle distal end; and a decorative attachment removably attached to the food utensil, the decorative attachment including a decorative element and a pair of laterally opposed attachment mating portions; wherein the handle defines a pair of laterally opposed handle mating portions formed in the handle, each handle mating portion snugly releasably mating with a respective one of the attachment mating portions to maintain the decorative element secured at a predetermined location along the handle, wherein the handle mating portions have geometric configurations that differ from each other so that the geometric configurations cannot be obtained one from an other through rotation, translation, or combinations thereof. The handle recesses 120 are thus an example of a handle mating portion, and the handle engaging prong free end portions 144 are thus an example of an attachment mating portion.

Also, attachments differing from a decorative attachment 104, such as a guard, could be mounted to the handle 106 similarly to the decorative attachment 104. Yet furthermore, the handle first and second surfaces 114 and 116 don't need to be flat and similar assemblies 100 in which these handle first and second surfaces 114 and 116 are curved are within the scope of the appended claims.

Although the present invention has been described hereinabove by way of exemplary embodiments thereof, it will be readily appreciated that many modifications are possible in the exemplary embodiments without materially departing from the novel teachings and advantages of this invention. Accordingly, the scope of the claims should not be limited by the exemplary embodiments, but should be given the broadest interpretation consistent with the description as a whole. The present invention can thus be modified without departing from the spirit and nature of the subject invention as defined in the appended claims.

What is claimed is:

1. An assembly comprising:

a food utensil defining a utility portion and a substantially elongated handle having substantially longitudinally opposed handle proximal and distal ends, the utility portion extending from the handle at the handle distal end, the handle defining substantially opposed handle first and second surfaces and a pair of handle lateral edges therebetween; and a decorative attachment removably attached to the food utensil, the decorative attachment including a decorative element provided at the handle first surface and a pair of laterally opposed handle engaging prongs having each a respective handle engaging prong free end portion provided on the handle second surface;

wherein the handle defines a pair of laterally opposed handle recesses formed in the handle second surface, each handle recess receiving thereinto a respective one of the handle engaging prong free end portion, the handle recesses and handle engaging prong free end portions being complementarily shaped to maintain the decorative element secured at a predetermined location along the handle; and wherein the handle recesses differ from being rotated images of each other and the handle engaging prong free end portions differ from being rotated images of each other.

2. The assembly as defined in claim 1, wherein at least one of the handle recesses and a corresponding one the handle engaging prong free end portions are polygonal.

3. The assembly as defined in claim 1, wherein an overall longitudinal length of a first one of the handle recesses is smaller than an overall longitudinal length of a second one of the handle recesses.

4. The assembly as defined in claim 3, wherein an overall lateral width of the first one of the handle recesses is larger than an overall lateral width of the second one of the handle recesses.

5. The assembly as defined in claim 1, wherein a first one of the handle recesses is substantially square and a second one of the handle recesses is substantially L-shaped.

6. The assembly as defined in claim 1, wherein a first one of the handle recesses is substantially rectangular and a second one of the handle recesses is substantially triangular.

7. The assembly as defined in claim 1, wherein the handle engaging prongs are resiliently deformable, the handle engaging prongs being biased against the handle when the decorative attachment is operatively secured to the handle with the handle engaging prong free end portions received in the handle recesses.

8. The assembly as defined in claim 7, wherein the decorative attachment is removable from the handle by disengaging the handle engaging prongs from the handle recesses and sliding the decorative attachment longitudinally along the handle.

9. The assembly as defined in claim 8, wherein at least one of the handle recesses and the handle engaging prong free end portions is beveled to facilitate disengaging of the handle engaging prongs from the handle recesses when the decorative attachment is moved longitudinally along the handle.

10. The assembly as defined in claim 8, wherein the handle engaging prong free end portions are separated by a gap, the gap being wider than a thickness of the handle at a removal location along the handle wherein the decorative attachment is removable from the handle.

11. The assembly as defined in claim 1, wherein the predetermined location is spaced apart from both the handle proximal and distal ends.

12. The assembly as defined in claim 1, wherein the handle second surface is provided with an indicia between the handle recesses.

13. The assembly as defined in claim 1, wherein the decorative attachment includes a support portion defining the handle engaging prongs and a decorative element mounted to the support portion.

14. The assembly as defined in claim 13, wherein the support portion includes a base abutting against the handle first surface, the handle engaging prongs extending from the base, a pair of opposed decorative element engaging prongs also extending from the base; and the decorative element defines a pair of opposed decorative element recesses, each decorative element engaging prongs being received in a respective one of the decorative element recesses to secure the decorative element to the support element.

15. The assembly as defined in claim 1, wherein the handle lateral edges each define a respective convex portion in register with the handle recesses; and the handle engaging prongs each define a respective concave portion in register with and receiving thereinto a respective one of the convex portions.

16. The assembly as defined in claim 1, wherein the decorative attachment extends substantially a whole handle length of the handle.

17. The assembly as defined in claim 1, wherein the utility portion is selected from the group consisting of a knife blade, a fork end and a spoon end.

18. An assembly comprising:

a food utensil defining a utility portion and a substantially elongated handle having substantially longitudinally opposed handle proximal and distal ends, the utility portion extending from the handle at the handle distal end; and a decorative attachment removably attached to the food utensil, the decorative attachment including a decorative element and a pair of laterally opposed attachment mating portions;

wherein the handle defines a pair of laterally opposed handle mating portions formed in the handle, each handle mating portion releasably mating with a respective one of the attachment mating portions to maintain the decorative element secured at a predetermined location along the handle, wherein the handle mating portions have geometric configurations that differ from each other so that the geometric configurations cannot be obtained one from an other through rotation, translation, or combinations thereof.

19. An assembly comprising:

a food utensil defining a utility portion and a substantially elongated handle having substantially longitudinally opposed handle proximal and distal ends, the utility portion extending from the handle at the handle distal end, the handle defining substantially opposed handle first and second surfaces and a pair of handle lateral edges therebetween; and a decorative attachment removably attached to the food utensil, the decorative attachment including a decorative element provided at the handle first surface and a pair of laterally opposed handle engaging prongs having each a respective handle engaging prong free end portion provided on the handle second surface;

wherein the handle defines a pair of laterally opposed handle recesses formed in the handle second surface, each handle recess receiving thereinto a respective one of the handle engaging prong free end portion, the handle recesses and handle engaging prong free end portions being complementarily shaped to maintain the decorative element secured at a predetermined location along the handle;

wherein the decorative attachment includes a support portion defining the handle engaging prongs and a decorative element mounted to the support portion;

the support portion includes a base abutting against the handle first surface, the handle engaging prongs extending from the base, a pair of opposed decorative element engaging prongs also extending from the base; and the decorative element defines a pair of opposed decorative element recesses, each decorative element engaging prongs being received in a respective one of the decorative element recesses to secure the decorative element to the support element.

* * * * *